US010524549B2

(12) United States Patent
Wang et al.

(10) Patent No.: US 10,524,549 B2
(45) Date of Patent: Jan. 7, 2020

(54) WEARABLE DEVICE

(71) Applicant: COMPAL ELECTRONICS, INC., Taipei (TW)

(72) Inventors: Tsung-Sung Wang, Taipei (TW); Kun-Chen Yang, Taipei (TW); Shih-Hai Yu, Taipei (TW)

(73) Assignee: COMPAL ELECTRONICS, INC, Tiapei (TW)

( * ) Notice: Subject to any disclaimer, the term of this patent is extended or adjusted under 35 U.S.C. 154(b) by 186 days.

(21) Appl. No.: 15/885,714

(22) Filed: Jan. 31, 2018

(65) Prior Publication Data

US 2019/0191828 A1 Jun. 27, 2019

(30) Foreign Application Priority Data

Dec. 22, 2017 (TW) ..... 106145244 A

(51) Int. Cl.

| | |
|---|---|
| ***A44C 5/14*** | (2006.01) |
| ***G04B 37/08*** | (2006.01) |
| ***G04B 37/14*** | (2006.01) |

(52) U.S. Cl.

CPC ..... *A44C 5/14* (2013.01); *G04B 37/08* (2013.01); *G04B 37/1486* (2013.01)

(58) Field of Classification Search

CPC ..... A44C 5/14; G04B 37/08; G04B 37/1486
See application file for complete search history.

(56) References Cited

U.S. PATENT DOCUMENTS

| | | | | |
|---|---|---|---|---|
| 3,973,099 | A * | 8/1976 | Morris, Sr. | G04C 3/001 200/511 |
| 9,742,085 | B2 * | 8/2017 | Tulloch | H01R 31/06 |
| 10,042,326 | B2 * | 8/2018 | Nicolas | A44C 5/14 |
| 10,085,523 | B2 * | 10/2018 | Perkins | A44B 17/0011 |
| 2017/0265607 | A1 | 9/2017 | Hatanaka et al. | |

FOREIGN PATENT DOCUMENTS

| | | | |
|---|---|---|---|
| CN | 104414036 | A | 3/2015 |
| CN | 105768408 | A | 7/2016 |
| CN | 205696117 | U | 11/2016 |
| JP | 2002101923 | A | 4/2002 |
| TW | 200724048 | A | 7/2007 |

OTHER PUBLICATIONS

English Machine Translation of CN205696117 (Year: 2016).*

* cited by examiner

*Primary Examiner* — Edwin A. Leon
*Assistant Examiner* — Jason M Collins
(74) *Attorney, Agent, or Firm* — Kirton McConkie; Evan R. Witt

(57) ABSTRACT

A wearable device comprises a main body and at least one belt. The main body comprises a casing, and the casing comprises at least one first engaging member and at least one first positioning member. The at least one belt comprises a connecting portion and an adapter. The adapter is connected to the connection portion of the at least one belt, and comprises at least one second engaging member and at least one second positioning member. The at least one first positioning member is connected to the at least one second positioning member correspondingly for positioning the belt on the main body. The at least one first engaging member is engaged with the at least one second engaging member correspondingly, so that the belt is fixed to the main body. Consequently, the main body and the belt connect to each other firmly and are easy to be assembled and disassembled.

11 Claims, 12 Drawing Sheets

2

2

WEARABLE DEVICE

FIELD OF THE INVENTION

The present invention relates to a wearable device, and more particularly to a wearable device in which the components can be assembled in the vertical direction.

BACKGROUND OF THE INVENTION

Since the development of technology and the requirement of consumers for the lightweight and portability of electronic devices, wearable devices with specific functions such as smartwatches have become popular consumer electronics products. The current smartwatches generally comprises a core having computing ability and straps, and not only has the timing function as traditional watch, but also has functional modules on their straps. Consequently, the smartwatches are provided with variety of functions. For the mentioned purpose, the core and the straps must have assembling structures to achieve the mechanical and electrical connection between the core and the straps. The assembling structures of the core and the straps should be fixed when the core and the straps are connecting for making the functional modules work continuously, furthermore, the assembling structures must be easy to be assembled and disassembled, so that the straps, which are used to carry the functional modules, can be replaced as required.

FIG. 1 is a schematic view illustrating assembling structures of the core and the straps of the smartwatch of a prior art. As shown in FIG. 1, portion of the strap 12 is inserted to the core 11 with horizontal direction relative to the core 11 so as to assemble the smartwatch 1. Although the assembling structures are easy to be assembled and disassembled in purpose, the core 11 and the straps 12 are easy to slide along the horizontal direction accidentally, which results from the shaking or impact when the smartwatch 1 is being used. Hence, the core 11 and the strap 12 would be misaligned or even detached from each other, which would lead the function of smartwatch 1 to fail.

Therefore, there is a need of developing assembling structures of main body and straps of an improved wearable device so as to obviate the drawbacks encountered from the prior art.

SUMMARY OF THE INVENTION

It is an object of the present invention to provide a wearable device which achieves the mechanical and electrical connection between the main body and the straps by a vertically-assembling manner, and is easy to be assembled and disassembled so that the main body and the straps can be replaced conveniently.

In accordance with an aspect of the present invention, a wearable device is provided. The wearable device comprises a main body and at least one strap. The main body comprises a casing, and the casing comprises at least one first engaging member and at least one first positioning member. The at least one strap comprises a connecting portion and an adapter. The adapter is connected to the connection portion of the at least one strap, and comprises at least one second engaging member and at least one second positioning member. The at least one first positioning member is connected to the at least one second positioning member correspondingly for positioning the strap on the main body. The at least one first engaging member is engaged with the at least one second engaging member correspondingly for fixing the strap to the main body.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
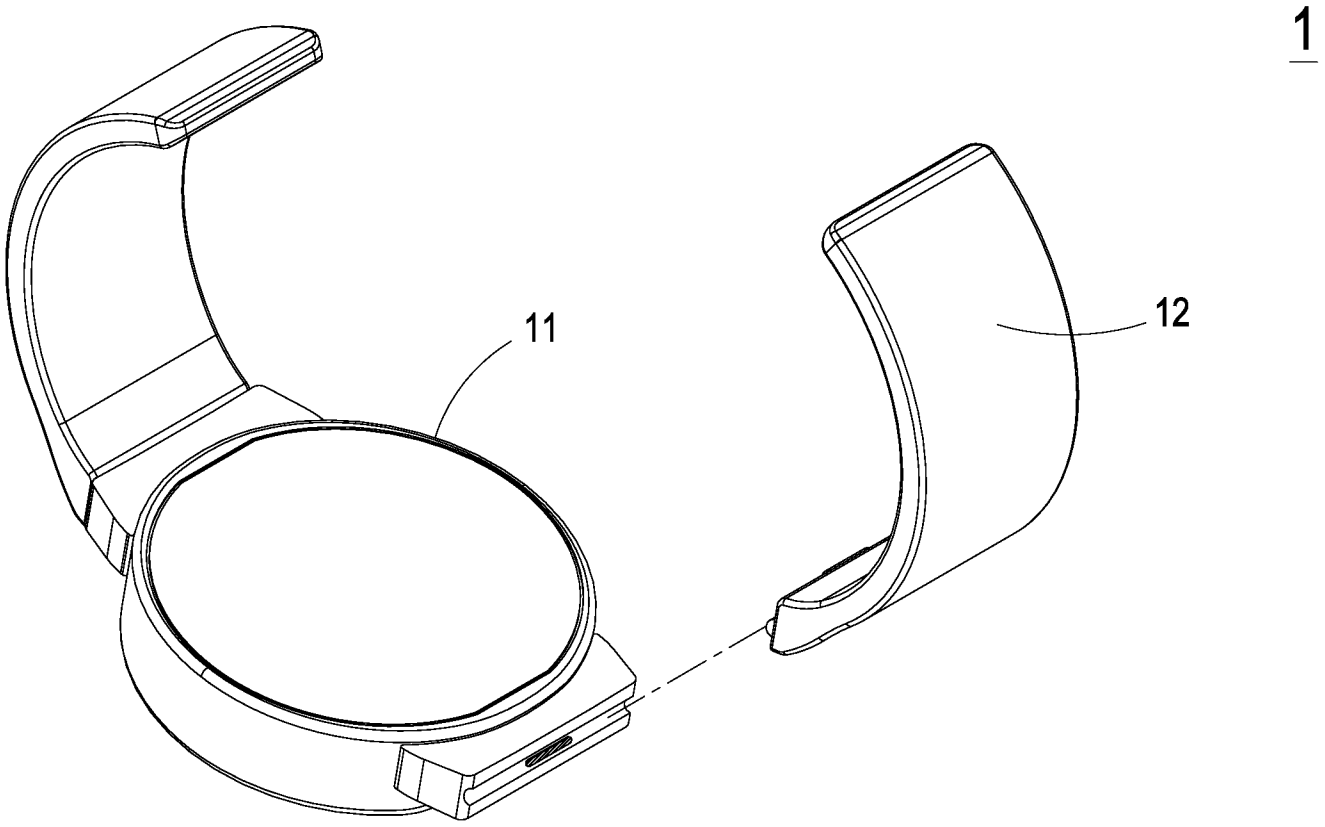
FIG.1 PRIOR ART
FIG. 1 is a schematic view illustrating the assembling structures of the core and the straps of the smartwatch of a prior art.
Figure 2:
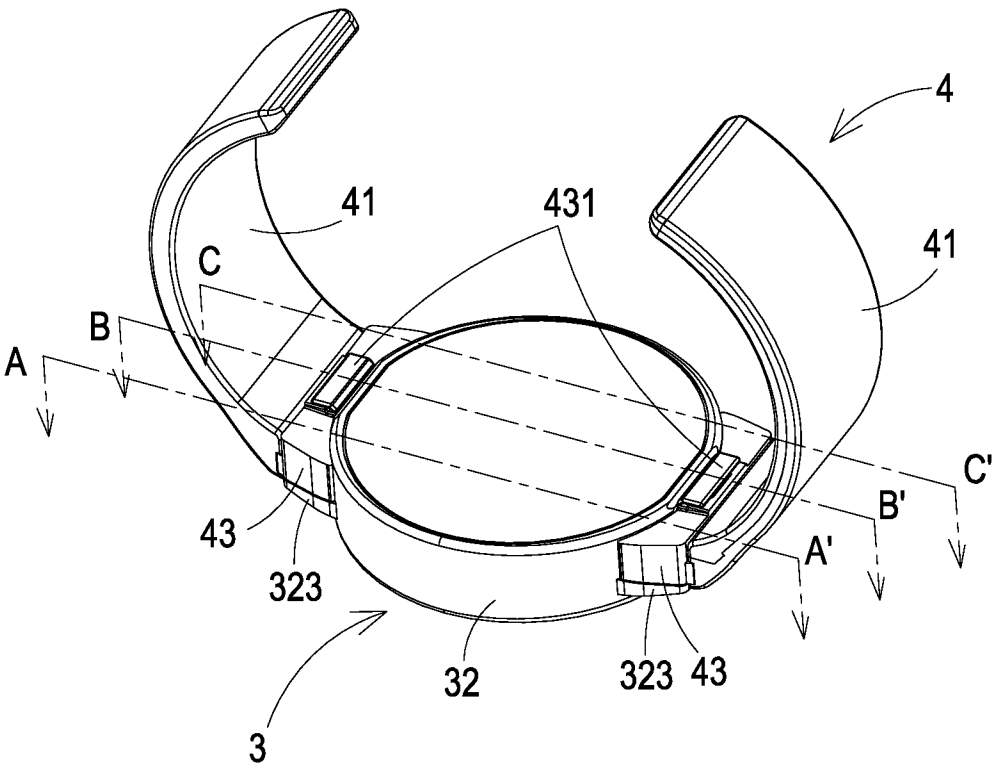
FIG. 2 is a schematic view illustrating the structure of the wearable device according to a preferred embodiment of the present invention when the main body and the strap are assembled.
Figure 3A:
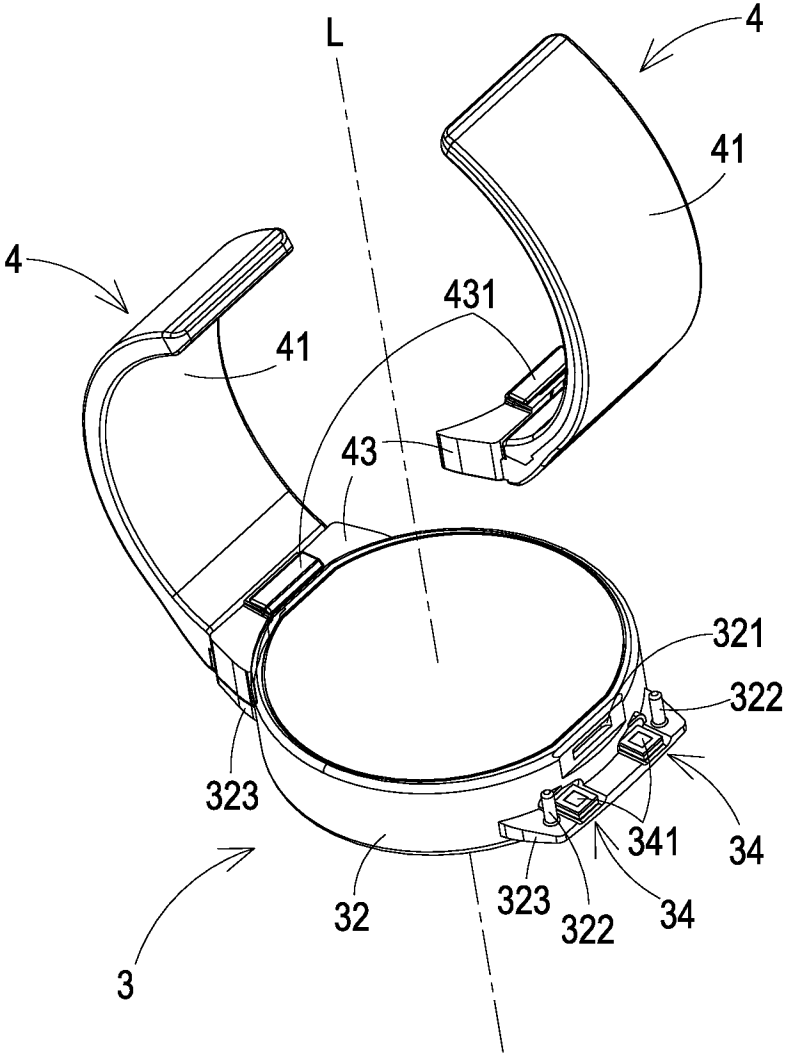
FIG. 3A is a schematic view illustrating the structure of the wearable device of FIG. 2 when the main body and the strap are disassembled.
Figure 3B:
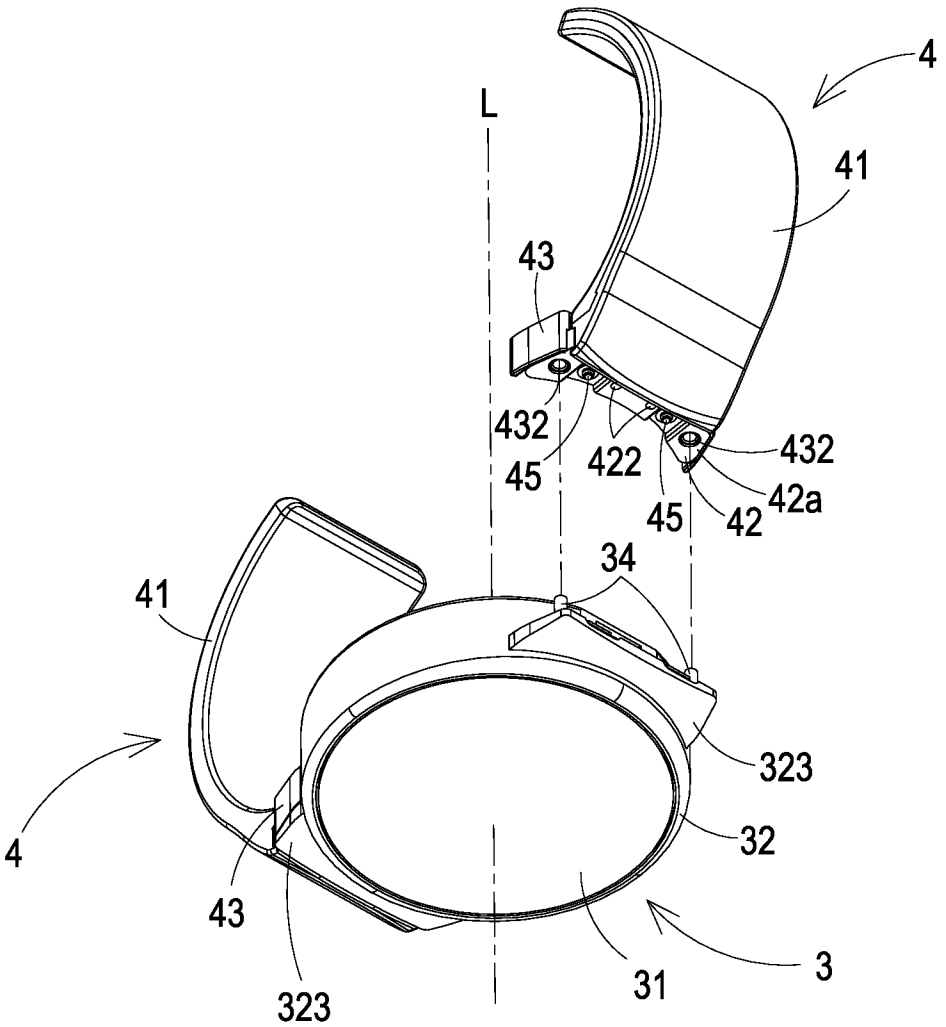
FIG. 3B is a schematic view illustrating the structure of the wearable device of FIG. 3A and taken along another viewpoint.

FIG. 2 is a schematic view illustrating the structure of the wearable device according to a preferred embodiment of the present invention when the main body and the strap are assembled. FIG. 3A is a schematic view illustrating the structure of the wearable device of FIG. 2 when the main body and the strap are disassembled. FIG. 3B is a schematic view illustrating the structure of the wearable device of FIG. 3A and taken along another viewpoint. As shown in FIGS. 2, 3A and 3B, the wearable device 2 comprises a main body 3 and at least one strap 4, for example, two straps 4. The main body 3 comprises an image display 31 and a casing 32. The casing 32 comprises at least one first engaging member 321 and at least one first positioning member 322. The image display 31 is partially embedded in the casing 32 and is configured to display information and provide an operating interface for controlling the operation of the wearable device 2. The strap 4 comprises a flexible strap 41, a connecting portion 42 and an adapter 43. The connecting portion 42 is disposed on the end of the flexible strap 41. The adapter 43 is connected to the connecting portion 42 and comprises at least one second engaging member 431 and at least one second positioning member 432. The second positioning member 432 of the adapter 43 is connected with the first positioning member 322 of the casing 32 correspondingly in a first direction parallel to a vertical line L of the main body 3 for positioning the strap 4 on the main body 3. The second engaging member 431 of the adapter 43 is engaged with the first engaging member 321 of the casing 32 correspondingly for fixing the strap 4 to the main body 3. When the second engaging member 431 of the adapter 43 is disengaged from the first engaging member 321 of the casing 32, the second positioning member 432 of the adapter 43 can be separated from the first positioning member 322 of the casing 32 along a second direction parallel to the vertical line L of the main body 3, wherein the second direction is opposite to the first direction. Consequently, the strap 4 is separated from the main body 3.

Figure 4:
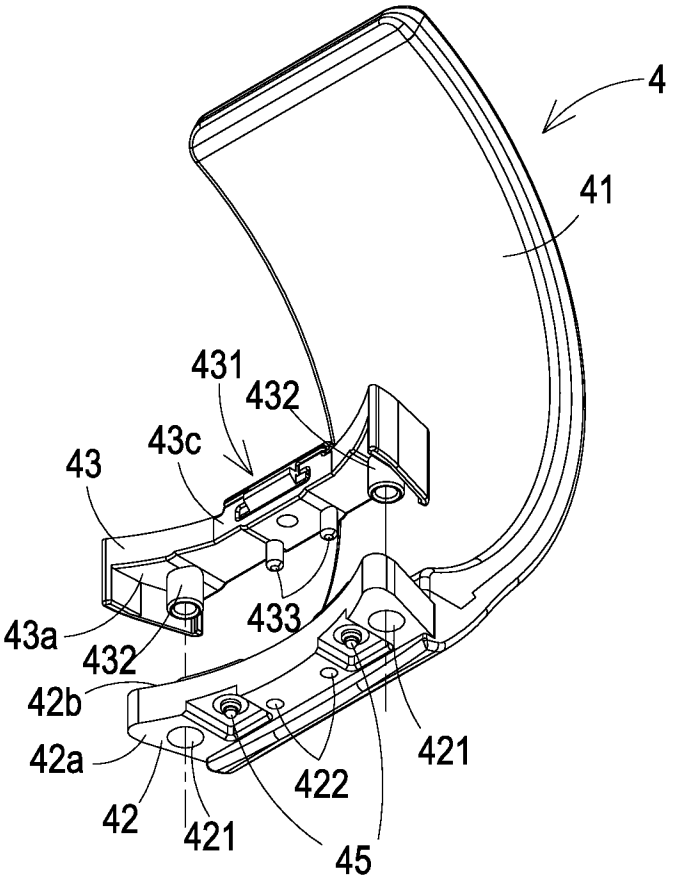
FIG. 4 is a schematic view illustrating the structure of the connecting portion and the adapter of the strap of FIG. 3A.

FIG. 4 is a schematic view illustrating the structure of the connecting portion and the adapter of the strap of FIG. 3A. As shown in FIGS. 2, 3A, 3B and 4, in this embodiment, the connecting portion 42 is located at the end of the flexible strap 41, and the connecting portion 42 and the adapter 43 are detachably connected to each other, but not limited thereto. However, in some embodiments, the connecting portion 42 and the adapter 43 may be integrally formed (not shown). In this embodiment, the connecting portion 42 comprises a first surface 42*a*, a second surface 42*b*, and at least one first perforation 421. The first surface 42*a* is opposite to the second surface 42*b*, and the at least one first perforation 421 passes through the first surface 42*a* and the second surface 42*b*. In this embodiment, the connecting portion 42 has two first perforations 421, and the two first perforations 421 are respectively disposed nearby the two opposite edges of the connecting portion 42. In some embodiments, the connecting portion 42 further comprises at least one third positioning member 422 disposed in a middle area of the connecting portion 42 and between the two first perforations 421. Preferably but not exclusively, the third positioning member 422 is a perforation passing through the first surface 42*a* and the second surface 42*b*. Preferably but not exclusively, the connecting portion 42 has two third positioning members 422, and the two third positioning members 422 are disposed adjacent to each other in the middle area of the connecting portion 42 and both located between the two first perforations 421.

In this embodiment, the adapter 43 comprises a first surface 43*a*, a second surface 43*b* and a third surface 43*c*. The first surface 43*a* is opposite to the second surface 43*b*, and the third surface 43*c* is adjacent to the first surface 43*a* and the second surface 43*b*. The at least one second positioning member 432 of the adapter 43 is located on the first surface 43*a*, and the at least one second engaging member 431 of the adapter 43 is located on the third surface 43*c*. When the strap 4 and the main body 3 are assembled, the first surface 43*a* of the adapter 43 is adjacent to the second surface 42*b* of the connecting portion 42, and the third surface 43*c* of the adapter 43 is fitting to the side surface of the casing 32. Preferably but not exclusively, the adapter 43 has two second positioning members 432, and the two second positioning members 432 are respectively disposed nearby the two opposite edges of the adapter 43 and are respectively aligned and connected with the two first perforations 421 of the connecting portions 42. Preferably but not exclusively, each of the second positioning members 432 is a bore column. The adapter 43 further comprises at least one fourth positioning member 433 located on the first surface 43*a*. The fourth positioning member 433 is aligned and connected to at least one third positioning member 422 of the connecting portion 42. Preferably but not exclusively, the fourth positioning member 433 is a positioning column, and is disposed on the first surface 43*a*. Preferably but not exclusively, the adapter 43 has two fourth positioning members 433, and the two fourth positioning members 433 are disposed in a middle area of the first surface 43*a* of the adapter 43, and are disposed adjacent to each other and both located between the two second positioning members 432. Alternatively, the third positioning member 422 of the connecting portion 42 may be a positioning column, and the fourth positioning member of the adapter 43 may be a perforation.

Figure 5A:
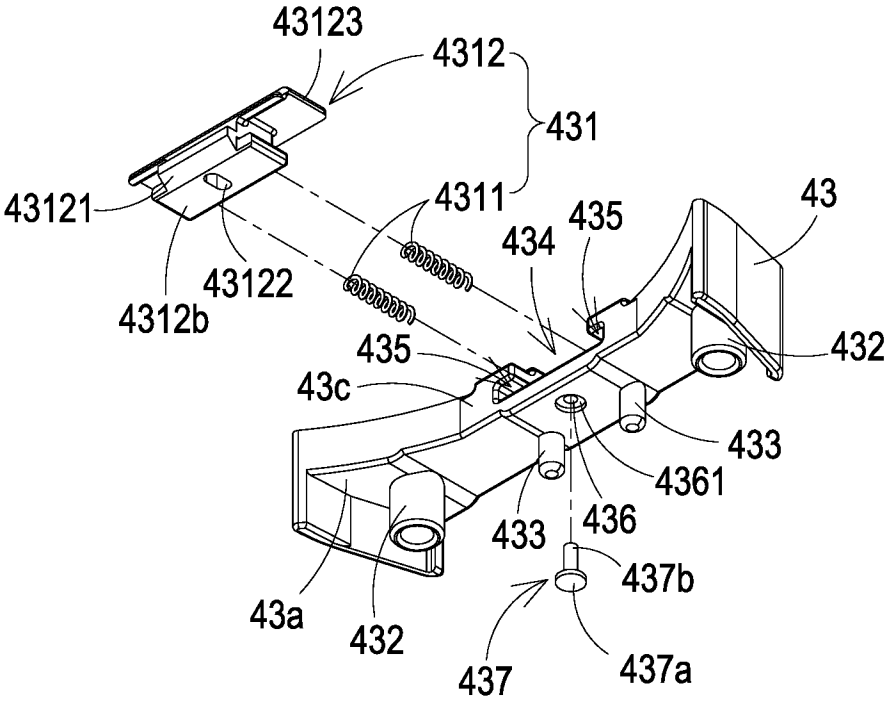
FIGS. 5A, 5B, and 5C are exploded views illustrating the structure of the adapter of FIG. 4 and taken along different viewpoints.
Figure 5B:
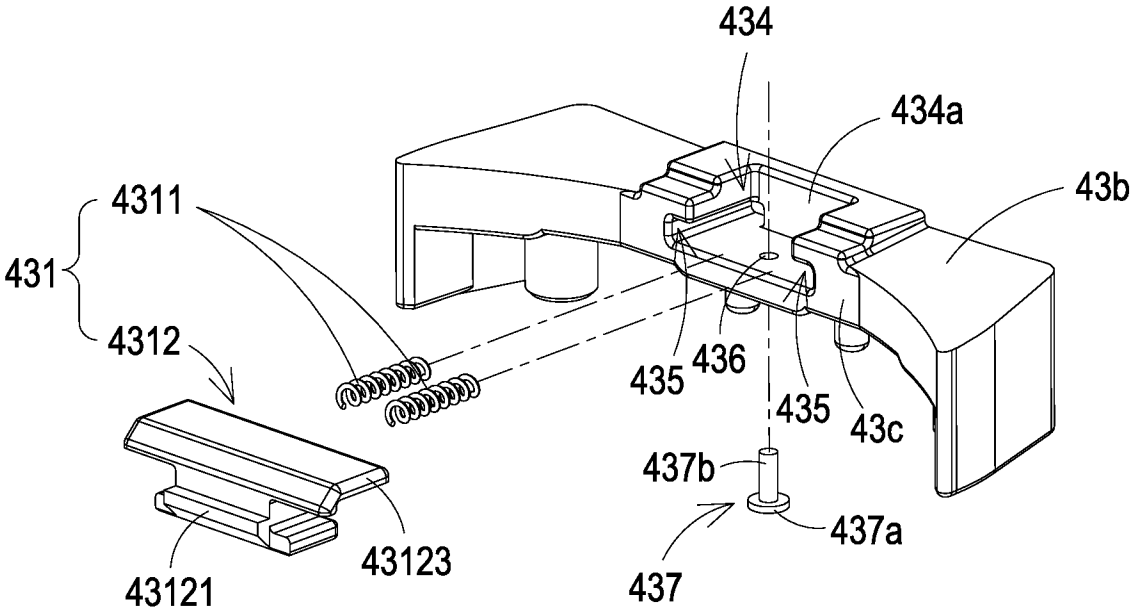
Figure 5C:
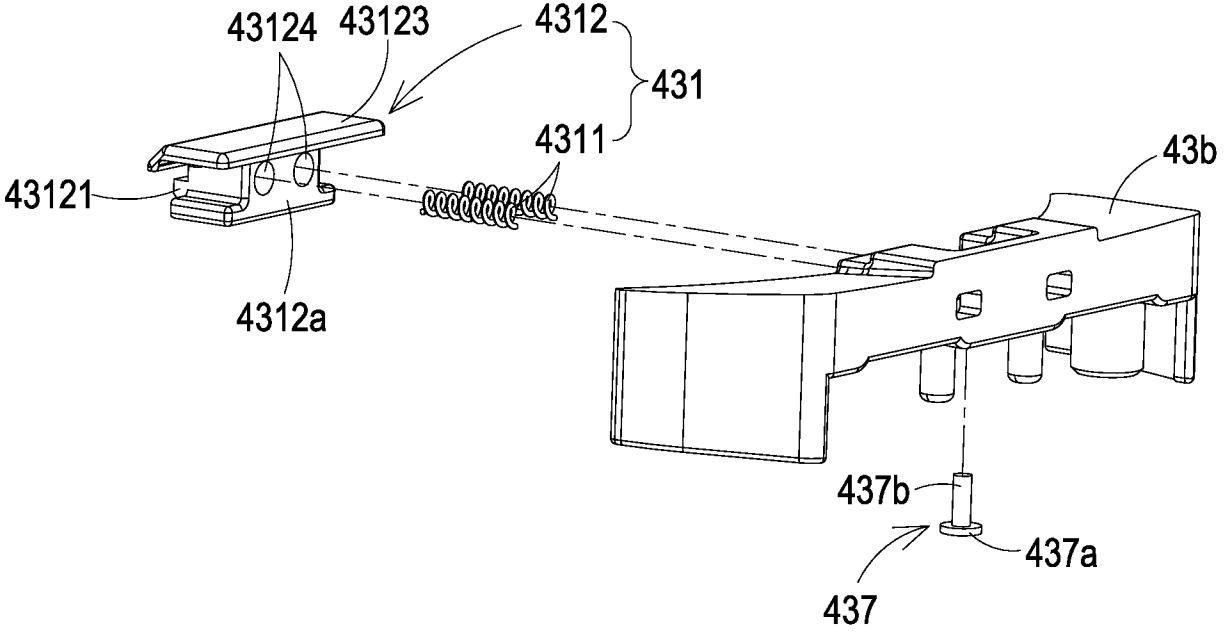

FIGS. 5A, 5B, and 5C are exploded view illustrating the structure of the adapter of FIG. 4 and taken along different viewpoints. As shown in FIGS. 5A, 5B and 5C, the adapter 43 further comprises a recess 434 and a sliding rail 435. The recess 434 is formed on the second surface 43*b* and comprises an opening and a sidewall 434*a*. The opening is located on the third surface 43*c*. Preferably but not exclusively, the recess 434 is formed in a middle area of the second surface 43*b*. The sliding rail 435 is disposed in the recess 434 and is formed on the surface perpendicular to the sidewall 434*a*. Preferably but not exclusively, the adapter 43 has two sliding rails 435, and the two sliding rails 435 are respectively disposed on two sidewalls adjacent to the bottom of the recess 434.

Moreover, in this embodiment, the second engaging member 431 of the adapter 43 comprises at least one elastic element 4311 and a slider 4312. The elastic element 4311 is disposed in the recess 434 and abuts against the sidewall 434*a* and the slider 4312. Preferably but not exclusively, the elastic element 4311 is a coil spring, and the second engaging member 431 includes two elastic elements 4311. In some embodiments, the elastic element 4311 can be fixed to at least one of the slider 4312 and the sidewall 434*a*, but not limited thereto. The slider 4312 comprises a first surface 4312*a* and a second surface 4312*b*, and the first surface 4312*a* is adjacent to the second surface 4312*b*. The slider 4312 is partially disposed in the recess 434 and is slidably engaged with the sliding rail 435 to slide along a direction perpendicular to the sidewall 434*a*. Meanwhile, the first surface 4312*a* abuts the at least one elastic element 4311, the second surface 4312*b* closely fits to the bottom of the recess 434, and the surface opposite to the first surface 4312*a* is exposed from the opening on the third surface 43*c* of the adapter 43. Preferably but not exclusively, the slider 4312 comprises the abutting portion 43121. The abutting portion 43121 is disposed on the surface opposite to the first surface 4312*a* and is exposed from the opening on the third surface 43*c* of the adapter 43. Preferably but not exclusively, in this embodiment, the abutting portion 43121 comprises a protruding portion comprising a chamfer cut from the second surface 4312*b*. In addition, as shown in FIG. 5C, the slider 4312 comprises at least one hole 43124 formed on the first surface 4312*a*, and the hole 43124 is configured to accommodate a part of the elastic element 4311 for positioning the slider 4312 and the elastic element 4311. In this embodiment, the slider 4312 comprises two holes 43124.

Moreover, in this embodiment, the slider 4312 further comprises a groove 43122. The adapter 43 further comprises a second perforation 436 and a fixing member 437. The groove 43122 has a specific length and is located on the second surface 4312*b* of the slider 4312. Preferably but not exclusively, the groove 43122 is disposed in a middle area of the second surface 4312*b* of the slider 4312. The second perforation 436 of the adapter 43 passes through the first surface 43*a* and the second surface 43*b* of the adapter 43 and is in communication with the recess 434 and corresponding to the groove 43122. In addition, the second perforation 436 further comprises an accommodating recess 4361 formed on the first surface 43*a* of the adapter 43. The fixing member 437 passes through the second perforation 436 and comprises a first end 437*a* and a second end 437*b*. The first end 437*a* has a flange and is correspondingly accommodated in the accommodating recess 4361 of the second perforation 436. The second end 437*b* is partially accommodated in the groove 43122 of the slider 4312. Preferably but not exclusively, the specific length of the groove 43122 is not less than the length of the abutting portion 43121. As a result, when the second end 437*b* of the fixing member 437 is abutting the end of the groove 43122, the abutting portion 43121 is exposed from the opening on the third surface 43*c* of adapter 43, and when the second end 437*b* of the fixing member 437 is abutting the other end of the groove 43122, the abutting portion 43121 is accommodated in the recess 434 of the adapter 43. Preferably but not exclusively, the fixing member 437 is a screw. Additionally, when the connecting portion 42 and the adapter 43 are assembled, the top surface of the first end 437*a* is in contact with the second surface 42*b* of the connecting portion 42. In an embodiment, the slider 4312 further comprises a covering portion 43123. The covering portion 43123 is disposed on a surface opposite to the second surface 4312*b* and is exposed outside the recess 434 and covers the gap between the slider 4312 and the recess 434.

As shown in FIGS. 3A and 3B, the casing 32 of the main body 3 comprises at least one extending portion 323. The first positioning member 322 of the casing 32 is disposed on the surface of the extending portion 323. In this embodiment, the casing 32 has two extending portions 323, and the extending portions 323 are respectively disposed on two opposite sides of the casing 32 and relatively close to the image display 31. Preferably but not exclusively, the casing 32 has two first positioning members 322, and the two first positioning members 322 are respectively disposed nearby the two opposite edges of the extending portion 323 and are corresponding to the second positioning members 432 of the adapter 43. Preferably but not exclusively, the first positioning member 322 is a positioning column. On the other hand, the first engaging member 321 of the casing 32 is disposed on the sidewall of the casing 32. Preferably but not exclusively, the casing 32 has two first engaging members 321, and the first engaging members 321 are respectively disposed above and nearby the two extending portions 323. Additionally, the first engaging member 321 is preferably located in a middle area between the two first positioning members 322 and is corresponding to the second engaging member 431 of the adapter 43. Preferably but not exclusively, the first engaging member 321 is a recess, and is corresponding to the abutting portion 43121 of the slider 4312.

Figure 6:
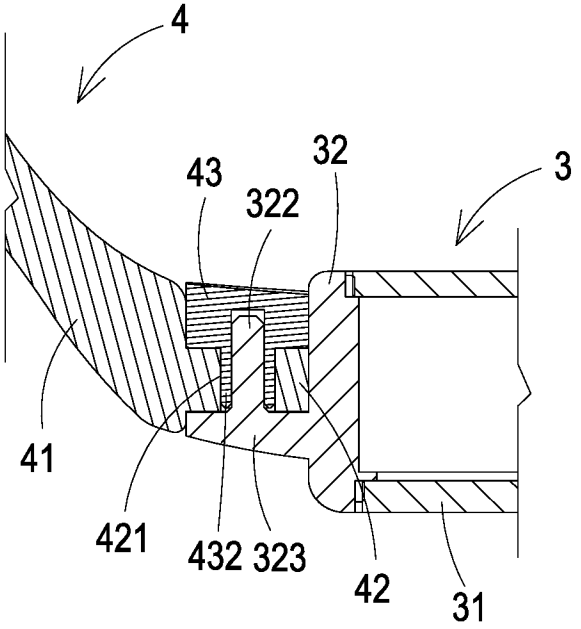
FIG. 6 is a partial cross-sectional view illustrating the structure of the main body and the strap along the section line A-A' of FIG. 2.

FIG. 6 is a partial cross-sectional view illustrating the structure of the main body and the strap along the section line A-A' of FIG. 2. As shown in FIGS. 2, 3A, 3B, 4 and 6, when the connecting portion 42 and the adapter 43 are assembled, the first perforation 421 of the connecting portion 42 and the second positioning member 432 of the adapter 43 are aligned and connected with each other, and the third positioning member 422 of the connecting portion 42 and the fourth positioning member 433 of the adapter 43 are aligned and connected with each other (not shown). When the strap 4 and the main body 3 are assembled, the second positioning member 432 is further aligned and connected to the first positioning member 322. In this embodiment, the second positioning member 432 is a bore column, and the first positioning member 322 is a positioning column. Therefore, when the connecting portion 42, the adapter 43 and the casing 32 are assembled together, the inner wall surface of the first perforation 421 closely contacts the outer wall surface of the second positioning member 432, and the inner wall surface of the second positioning member 432 closely contacts the wall surface of the first positioning member 322 so as to position the strap 4 on the main body 3. Preferably but not exclusively, the connecting portion 42 is sandwiched between the adapter 43 and the extending portion 323 of the casing 32.

Figure 7:
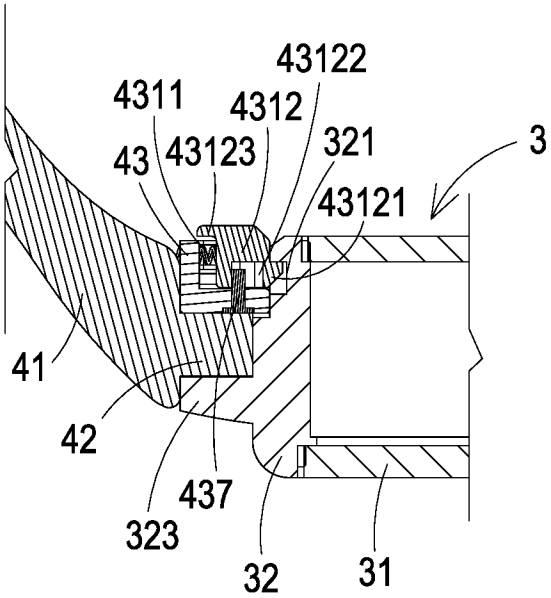
FIG. 7 is a partial cross-sectional view illustrating the structure of the main body and the strap along the section line B-B' of FIG. 2.

FIG. 7 is a partial cross-sectional view illustrating the structure of the main body and the strap along the section line B-B' of FIG. 2. As shown in FIGS. 2, 3A, 3B, 4, 5 and 7, when the main body 3 and the strap 4 are assembled and fixed to each other, the first engaging member 321 of the casing 32 is engaged with the second engaging member 431 of the adapter 43. In this embodiment, the first engaging member 321 is a slot, and the second engaging member 431 comprises the slider 4312 and the abutting portion 43121 thereof. When the main body 3 and the strap 4 are assembled, the abutting portion 43121 of the slider 4312 is embedded in the slot of the casing 32, and the abutting portion 43121 and the slot are engaged with each other by the abutment of the elastic element 4311, so that the main body 3 and the strap 4 are fixed to each other. In this embodiment, when the strap 4 is being assembled to the main body 3 along the first direction parallel to the vertical line L of the main body 3, the chamfer of the abutting portion 43121 can lead the slider 4312 to slide toward the sidewall 434*a* of the recess 434, so that the abutting portion 43121 can be easily embedded into the first engaging member 321 (i.e., the slot) of the casing 32. In addition, when a user applies a force on the covering portion 43123 to move the slider 4312 toward the sidewall 434*a* and concomitantly compress the elastic element 4311, thereby disengaging the abutting portion 43121 from the slot, and separating the strap 4 from the main body 3 along the second direction parallel to the vertical line L of the main body 3. In this embodiment, the sliding range of the slider 4312 compared to the adapter 43 is limited by a specific length of the groove 43122 because of the fixing member 437. In this embodiment, the covering portion 43123 is not only configured to make the slider 4312 easy to be pressed and moved, but also prevents the dust from entering the gap between the slider 4312 and the recess 434. As the results, the slider 4312 can still be smoothly used to engage and disengage after repeated use.

Figure 8:
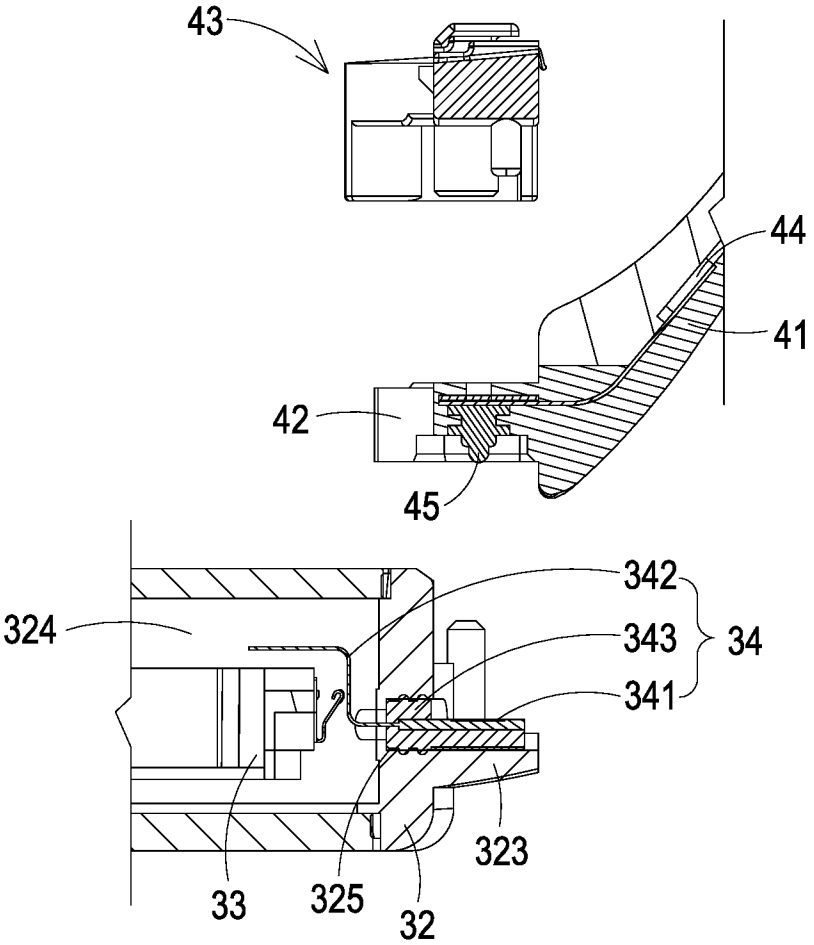
FIG. 8 is a partial cross-sectional view illustrating the structure of the adapter, the connecting portion, and the casing along the section line C-C' of FIG. 2.

FIG. 8 is a partial cross-sectional view illustrating the structure of the adapter, the connecting portion, and the casing along the section line C-C' of FIG. 2. As shown in FIGS. 3A, 3B, 4 and 8, the casing 32 further comprises an accommodating space 324 and at least one through hole 325. At least one through hole 325 is disposed on the sidewall of the casing 32 and above the extending portion 323. In this embodiment, the casing 32 preferably includes four through holes 325 arranged in pairs. Furthermore, the two pairs of through holes 325 are respectively located at the two opposite sides of the casing 32 and located between the two first positioning members 322. The main body 3 further comprises a printed circuit board 33 and at least one contact pad assembly 34. The printed circuit board 33 is disposed in the accommodating space 324. At least one contact pad assembly 34 comprises at least one contact pad 341 and at least one conductor 342. The contact pad 341 is correspondingly connected to a conductor 342. In addition, the conductor 342 correspondingly passes through the through hole 325 and connects to the printed circuit board 33. Preferably but not exclusively, the main body 3 includes two contact pad assemblies 34 and located at two opposite sides of the casing 32. Furthermore, the contact pad assembly 34 includes two contact pads 341 and two conductors 342, the contact pads 341 are at least partially disposed on the extending portion 323 outside the casing 32, and each of the conductors 342 passes through a through hole 325. Preferably but not exclusively, the conductor 342 is a sheet. In an embodiment, the contact pad assembly 34 further comprises at least one waterproof element 343, and the waterproof element 343 is correspondingly disposed around a part of a conductor 342, located at the junction of the contact pad 341 and the conductor 342, and accommodated in the through hole 325. Preferably but not exclusively, each contact pad assembly 34 includes two waterproof elements 343. In this embodiment, the strap 4 further comprises at least one functional module 44 and at least one contactor 45. The contactor 45 is electrically connected to the functional module 44. The contactor 45 is disposed on the first surface 42*a* of the connecting portion 42 and is corresponding to the contact pad 341 of the main body 3. Preferably but not exclusively, the strap 4 includes two contactors 45, and both the two contactors 45 are disposed between the two first perforations 421. In addition, the contactor 45 is preferably a spring pin.

Moreover, when the adapter 43, the connecting portion 42 and the casing 32 are assembled together, the printed circuit board 33 disposed in the main body 3 and the functional module 44 in the strap 4 can be electrically connected by connecting the contactor 45 to the contact pad 341, so that the data or power provided by the functional module 44 of the wearable device 2 is transmitted to the printed circuit board 33 of the main body 3 for computing or supplying power. Consequently, the information would be displayed by the image display 31. In addition, the waterproof element 343 can be used to prevent moisture or dust from entering into the accommodating space 324 through the through hole 325, thereby protecting the printed circuit board 33 from being damaged.

In this embodiment, the functional module 44 of the strap 4 and the printed circuit board 33 of the main body 3 are electrically connected with each other by the contact pad 341 and the contactor 45. In addition, due to the first positioning member 322, the second positioning member 432, the first engaging member 321, and the second engaging member 431, the main body 3 and the strap 4 can be positioned and fixed to each other, and while the wearable device 2 is being used, the electrical connection between the function module 44 and the printed circuit board 33 is maintained. In addition, the first engaging member 321 and the second engaging member 431 can be disengaged by simply moving the slider 4312, so as to separate the main body 3 and the strap 4, and further replace the main body 3 or the strap 4. It should be emphasized that in other embodiments of the present invention, in spite of the main body 3 omitting the contact pad assembly 34 and the strap 4 omitting the functional module 44 and the contactor 45, the mechanical assembly of the wearable device 2 can still be achieved.

Figure 9:
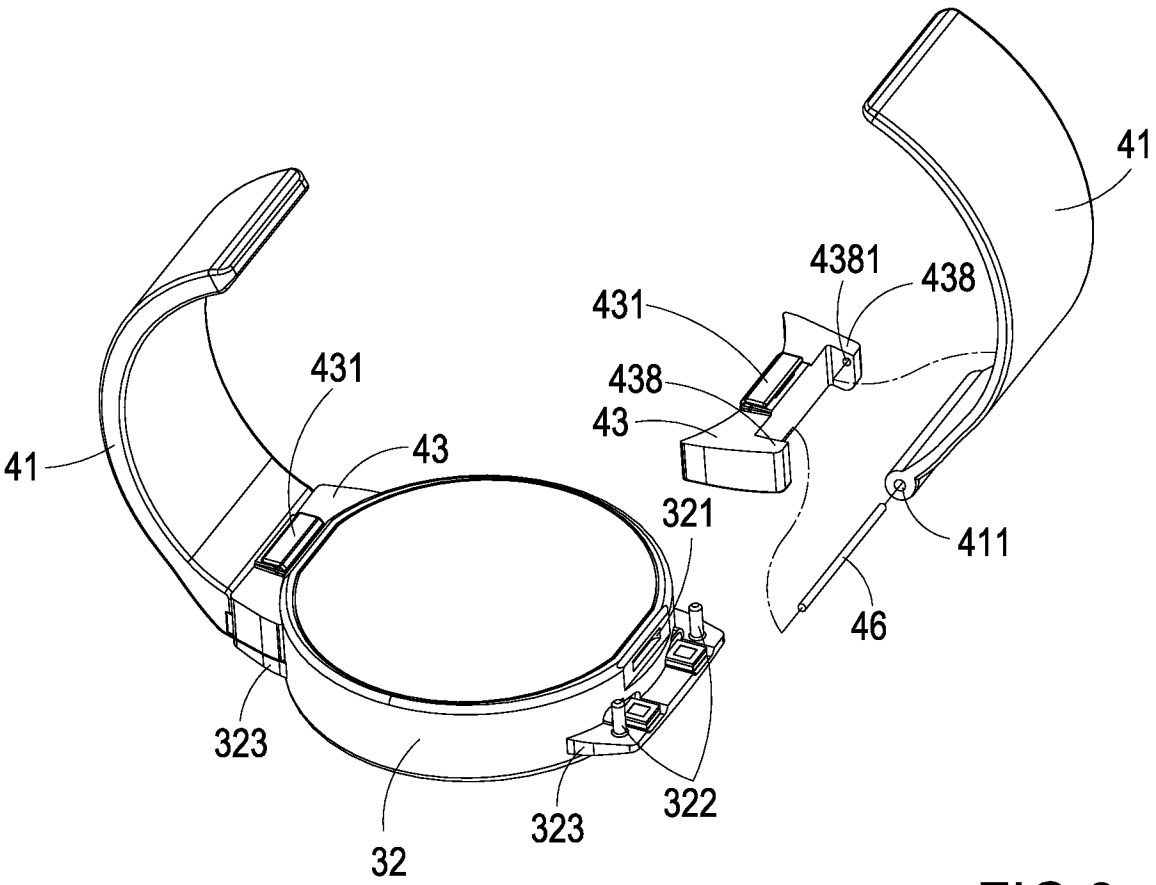
FIG. 9 is a schematic view illustrating the exemplary structure of the belt of the wearable device according to an embodiment of the present invention.

FIG. 9 is a schematic view illustrating the exemplary structure of the strap of the wearable device according to an embodiment of the present invention. As shown in FIG. 9, in this embodiment, the strap 4 of the wearable device 2 comprises a flexible strap 41, a connecting portion 42 and an adapter 43. The connecting portion 42 and the adapter 43 are integrally formed. The adapter 43 comprises two ears 438, and each of the ears 438 comprises a hole 4381. One end of the flexible strap 41 comprises a tubular portion 411, and two ends of the tubular portion 411 are respectively aligned with the holes 4381 of the two ears 438. The strap 4 of the wearable device 2 further comprises a retractable rod 46 penetrating through the tubular portion 411. The two ends of the retractable rod 46 are respectively aligned to and accommodated in the two holes 4381 of the two ears 438, so as to assemble and disassemble the flexible strap 41 as required.

From the above descriptions, the present invention provides the assembling structures of main body and strap of an improved wearable device that allow the main body and the strap of the wearable device to be securely connected with each other by a vertically-assembling manner, therefore the function module disposed on the strap could work continuously. Additionally, the main body and the strap could be easily detached from each other so that the main body or the strap could be replaced conveniently.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A wearable device, comprising:

a main body comprising a casing, wherein the casing comprises at least one first engaging member and at least one first positioning member; and at least one strap comprising:

a connecting portion; and an adapter connected to the connecting portion of the at least one strap and comprising at least one second engaging member-em, at least one second positioning member, a first surface, a second surface, a third surface, a recess and a sliding rail;

wherein the at least one first positioning member is connected to the at least one second positioning member correspondingly for positioning the strap on the main body, and the at least one first engaging member is engaged with the at least one second engaging member correspondingly for fixing the strap to the main body, wherein the first surface is opposite to the second surface, and the third surface is adjacent to the first surface and the second surface, the second positioning member is disposed on the first surface, the recess is formed on the second surface and has an opening on the third surface, wherein the slide rail is located in the recess, the second engaging member comprises a slider and at least one elastic element, wherein the slider is disposed in the recess and slidably disposed in the sliding rail, and a pan of the slider is exposed on the third surface, the at least one elastic element is disposed between the slider and a sidewall of the recess for abutting the slider, wherein the slider has an abutting portion configured to engage with or disengaged from the first engaging member of the main body, so that the strap is connected with or separated with the main body.

2. The wearable device according to claim 1, wherein the second positioning member of the adapter is connected to the first positioning member of the casing along a first direction of a vertical line of the main body for positioning the strap on the main body, wherein while the first engaging member of the casing and the second engaging member of the adapter are disengaged with each other, the second positioning member of the adapter is separated from the first positioning member of the casing along a second direction of the vertical line for detaching the strap from the main body, wherein the second direction is opposite to the first direction.

3. The wearable device according to claim 1, wherein the casing comprises at least one extending portion, and the at least one first positioning member is disposed on the at least one extending portion.

4. The wearable device according to claim 1, wherein the connecting portion comprises a first surface, a second surface and at least one first perforation, wherein the first surface is opposite to the second surface, the at least one first perforation passes through the first surface and the second surface, and the at least one second positioning member of the adapter is aligned and connected with the at least one first perforation.

5. The wearable device according to claim 4, wherein the at least one first positioning member is a positioning column, and the at least one second positioning member is a bore column.

6. The wearable device according to claim 1, wherein the connecting portion of the strap comprises at least one third positioning member and the adapter comprises at least one fourth positioning member, wherein the at least one fourth positioning member is aligned and connected with the at least one third positioning member, so that the adapter is connected with the connecting portion.

7. The wearable device according to claim 6, wherein the third positioning member is a perforation, and the fourth positioning member is a column, or the third positioning member is a column, and the fourth positioning member is a perforation.

8. The wearable device according to claim 1, wherein the adapter comprises a second perforation and a fixing member, and the slider comprises a groove, wherein the second perforation penetrates the first surface and the second surface of the adapter and is in communication with the recess, the fixing member passes through the second perforation from the first surface of the adapter and is partially accommodated in the groove of the slider, so that the movement of the slider is limited by a length of the groove.

9. The wearable device according to claim 1, wherein the casing comprises an accommodating space and at least one through hole, and the main body further comprises:

- a printed circuit board disposed in the accommodating space of the casing; and
- a contact pad assembly comprising:
  - at least one contact pad at least partially disposed on the outside of the casing; and
  - at least one conductor partially penetrating through the at least one through hole of the casing and connecting with the at least one contact pad and the printed circuit board.

10. The wearable device according to claim 9, wherein the contact pad assembly comprises at least one waterproof member, wherein the waterproof member is disposed at the junction of the at least one contact pad and the at least one conductor and is accommodated in the through hole.

11. The wearable device according to claim 9, wherein the strap comprises at least one functional module and at least one contactor, wherein the at least one contactor is electrically connected to the at least one functional module, and the at least one contactor is configured to connect to the at least one contact pad of the main body.

* * * * *